US012808186B2

(12) United States Patent
Guo et al.

(10) Patent No.: US 12,808,186 B2
(45) Date of Patent: Nov. 24, 2026

(54) SELF-ADAPTIVE VISCOUS DAMPING WALL

(71) Applicant: Southeast University, Jiangsu (CN)

(72) Inventors: Tong Guo, Jiangsu (CN); Gang Xu, Jiangsu (CN); Aiqun Li, Jiangsu (CN); Zhiqiang Zhang, Jiangsu (CN); Hengyuan Zhang, Jiangsu (CN); Shiyuan Wang, Jiangsu (CN)

(73) Assignee: Southeast University, Jiangsu (CN)

( * ) Notice: Subject to any disclaimer, the term of this patent is extended or adjusted under 35 U.S.C. 154(b) by 100 days.

(21) Appl. No.: 19/001,343

(22) Filed: Dec. 24, 2024

(65) Prior Publication Data

US 2025/0243663 A1 Jul. 31, 2025

(30) Foreign Application Priority Data

Jan. 26, 2024 (CN) ..... 202410107772.9

(51) Int. Cl.
*E04B 1/98* (2006.01)
*E04B 2/00* (2006.01)
*E04H 9/02* (2006.01)

(52) U.S. Cl.
CPC ..... *E04B 1/98* (2013.01); *E04B 2/00* (2013.01); *E04H 9/0237* (2020.05); *E04B 2103/06* (2013.01); *E04H 9/02* (2013.01); *E04H 9/0215* (2020.05); *E04H 9/0235* (2020.05); *E04H 9/027* (2013.01)

(58) Field of Classification Search
CPC ..... E04B 1/98; E04B 2103/06; E04H 9/02; E04H 9/0215; E04H 9/0235; E04H 9/0237; E04H 9/027
See application file for complete search history.

(56) References Cited

U.S. PATENT DOCUMENTS 8,763,320 B1 * 7/2014 Chou ..... E04H 12/16 52/167.3
10,954,685 B1 * 3/2021 Guo ..... E04H 9/0237
2018/0266101 A1 * 9/2018 Haba ..... E04B 1/388
2021/0088102 A1 * 3/2021 Guo ..... F16F 13/00
(Continued)

FOREIGN PATENT DOCUMENTS

CN 102296726 A * 12/2011
CN 110230402 A * 9/2019 ..... E04G 21/14
(Continued)

*Primary Examiner* — Brian D Mattei
*Assistant Examiner* — Zakaria Khaled Al-Aswar
(74) *Attorney, Agent, or Firm* — JCIPRNET

(57) ABSTRACT

A self-adaptive viscous damping wall includes upper and lower fixed ends, an outer box body, an inner steel plate, a viscous fluid, and a self-centering device. The inner steel plate has openings, and the inner steel plate is divided into vertical wide bands, and two side faces of the bands are shear faces of the inner steel plate. An upper end of the inner steel plate is fixed to the upper fixed end. The outer box body has an upper opening for accommodating the inner steel plate and the viscous fluid. A part of an inner surface of the outer box body corresponding to a horizontal movement interval of the shear face of the inner steel plate is a shear face of the outer box body, which is designed with a multi-section curved face, with a flat and straight middle portion and a gradually decreasing end portion.

7 Claims, 5 Drawing Sheets

(56) References Cited

U.S. PATENT DOCUMENTS

| | | | | |
|---|---|---|---|---|
| 2021/0108410 | A1* | 4/2021 | Pring | E04B 1/943 |
| 2021/0277681 | A1* | 9/2021 | Lee | E04H 1/04 |
| 2022/0049519 | A1* | 2/2022 | Chi | E04H 9/0237 |
| 2025/0243663 | A1* | 7/2025 | Guo | E04H 9/0235 |

FOREIGN PATENT DOCUMENTS

| | | | | | |
|---|---|---|---|---|---|
| CN | 211143368 | U | * | 7/2020 | |
| CN | 211447320 | U | * | 9/2020 | |
| CN | 112177193 | A | * | 1/2021 | E04H 9/02 |
| CN | 113202200 | A | * | 8/2021 | E04H 9/02 |
| CN | 113685072 | A | * | 11/2021 | E01D 19/00 |
| CN | 214657933 | U | * | 11/2021 | |
| CN | 114922494 | A | * | 8/2022 | E04H 9/0237 |
| CN | 117145084 | A | * | 12/2023 | E04H 9/023 |
| CN | 118166929 | A | * | 6/2024 | F16F 15/04 |
| JP | 3436197 | B2 | * | 8/2003 | |
| JP | 2005089965 | A | * | 4/2005 | |
| JP | 2005331035 | A | * | 12/2005 | |
| JP | 4019511 | B2 | * | 12/2007 | |
| JP | 2009068668 | A | * | 4/2009 | |
| JP | 2014013048 | A | * | 1/2014 | |
| WO | WO-2020070665 | A1 | * | 4/2020 | E04C 3/083 |

* cited by examiner

SELF-ADAPTIVE VISCOUS DAMPING WALL

CROSS-REFERENCE TO RELATED APPLICATION

This application claims the priority benefit of China application serial no. 202410107772.9, filed on Jan. 26, 2024. The entirety of the above-mentioned patent application is hereby incorporated by reference herein and made a part of this specification.

BACKGROUND

Technical Field

The present invention belongs to the technical field of structural engineering seismic reduction, and specifically to a self-adaptive viscous damping wall.

Description of Related Art

Seismic design is an important way to protect people's life and property safety and maintain structural integrity and safety in earthquakes. In recent years, multiple strong earthquakes in countries such as China, Chile, New Zealand, and Japan have shown that the traditional "seismic resistance" design idea can ensure that structures do not collapse under seismic fortification levels, but a large number of buildings become "standing ruins" after earthquakes, and repair or reconstruction still causes significant economic losses. Therefore, it has become the goal of earthquake prevention and disaster reduction in many cities in China to improve the seismic resilience of buildings and enable buildings to maintain and restore their original functions after being subjected to specific levels of earthquake action.

Under this background, self-centering technology, as an emerging technology to improve the seismic resilience of building structures, has attracted extensive attention. Self-centering technology not only avoids plastic damage to structures, which only produces geometric nonlinear behavior at the joints or inside the specified components, with a greater deformation capability, but also has the combination of the self-centering device and the energy dissipation device, with effective self-centering and energy dissipation capabilities. However, self-centering technology demonstrates limited advantages in controlling peak displacement, acceleration, and energy dissipation. Additionally, the current research on self-centering components or structures is often based on the idealized "flag-shaped" hysteretic model, which assumes complete self-centering capability—a simplification that does not align with real-world behavior. Furthermore, even if a design fully eliminates post-earthquake residual deformation, such a scheme may prove inefficient and economically impractical.

Structural energy dissipation and seismic reduction technology is also a widely used technology in the field of earthquake engineering. A viscous damping wall is an effective energy dissipation and seismic reduction device, which causes shear deformation by the high viscosity fluid medium between inner and outer box bodies, and dissipates vibration energy by the internal friction force of the viscous fluid medium to reduce the seismic or wind-induced response of the structure. The viscous damping wall is a damping device related to both velocity and displacement, and possesses many excellent properties. For example, compared with the traditional rod-type viscous damper, it has a better damping force effect and avoids issues such as leakage and fatigue damage under high-speed and high-pressure conditions. It is easy to install, with a simple device configuration, and construction errors have minimal impact on its seismic reduction performance, resulting in low maintenance costs over time. It also has a flexible layout and a wide application range, and can be used in new and existing frame, frame-shear wall and multi-high-rise structures.

However, the viscous damping wall can produce relatively large damping force under minor earthquakes, but the growth of damping force under rare earthquakes is relatively gentle, resulting in the seismic reduction effect of "both minor earthquakes and major earthquakes cannot be taken into account"; its additional stiffness gradually decreases with the increase of peak acceleration or displacement amplitude of seismic waves; and the viscous damping wall does not have self-centering ability after earthquakes, thus making it difficult to control residual displacement of the structure. These problems are particularly obvious in many buildings in high-intensity areas in China, and with the height and span increase and structural complexity of buildings, seismic challenges become more prominent. Traditional seismic and seismic reduction designs have great challenges in taking into account both economic and multi-performance objectives.

SUMMARY

In order to solve the above problems, the present invention discloses a self-adaptive viscous damping wall, which incorporates self-centering technology and viscous damping technology, and introduces variable viscous damping characteristics, which can significantly improve the seismic reduction efficiency and self-centering capability of a structure.

In order to achieve the above object, the technical solution of the present invention is as follows:

A self-adaptive viscous damping wall, including an upper fixed end, a lower fixed end, an outer box body, an inner steel plate, a viscous fluid, a stiffening key, disc spring groups, a sliding plate, a high-strength bolt, a pressure transmission plate, a cushion block, an opening, an anchoring angle, and a stiffening plate.

The inner steel plate is a straight steel plate provided with a plurality of openings, so that the inner steel plate is divided into several vertical wide bands, and two side faces of the vertical wide bands are shear faces of the inner steel plate. An upper end of the inner steel plate is fixedly connected with the upper fixed end, which is reinforced by the stiffening key to ensure effective transmission of horizontal shear force. In order to prevent the inner steel plate from warping and instability in a working state, several cushion blocks are disposed between an outer side of the inner steel plate and the outer box body.

The outer box body is a vertical barrel-shaped component with an upper opening capable of accommodating the inner steel plate and the viscous fluid, two sides of an upper portion of the outer box body are provided with notches, and a bottom portion is the lower fixed end, which is configured for bottom end anchoring. In order to ensure the safety and reliability of the outer box body, several stiffening plates are disposed on an outer side of the outer box body according to a construction requirement.

A part of an inner surface of the outer box body corresponding to a horizontal movement interval of the shear face of the inner steel plate is a shear face of the outer box body, the shear face of the outer box body is designed with a multi-section curved face, the curved face adopts a special design of a flat and straight middle portion and a gradually decreasing end portion (an internal cross section is waist-shaped) according to a design need of a seismic objective, and specific parameters are calculated according to required damping force or determined through an experiment.

A distance between the shear face of the outer box body and the shear face of the inner steel plate is a shear gap. When the upper fixed end and the lower fixed end generate horizontal relative motion, the inner steel plate and the outer box body are driven to generate relative displacement, and then the viscous fluid in the shear gap is driven to undergo shear deformation, thereby generating viscous damping force and then dissipating energy.

The shear face of the outer box body is of a special curved face design, so in an initial state or when an amount of horizontal relative motion generated by the upper fixed end and the lower fixed end is relatively small (minor earthquake), a shear gap is fixed and unchanged, and viscous damping force only changes with a motion speed and is weakly correlated with displacement; and when the horizontal relative motion gradually increases (major earthquake), the shear gap gradually decreases, and the viscous damping force gradually increases, so the viscous damping force not only changes with the motion speed, but also is strongly correlated with the displacement. In short, the shear gap changes during the motion, so that variable viscous damping force can be generated according to design target displacement, which improves damping efficiency and adaptability.

The self-centering device is disposed at the upper portion of the outer box body, and the device consists of disc spring groups, a sliding plate, a high-strength bolt, a pressure transmission plate, and an anchoring angle, where the disc spring groups are threaded on the high-strength bolt, the sliding plate is disposed at two ends of the two disc spring groups, a gap is left between the two disc spring groups and allows the inner steel plate to be inserted, the pressure transmission plate is disposed on an outer side of the sliding plate, the pressure transmission plate is disposed at a lower portion of the upper fixed end, the anchoring angle is disposed at the notch of the upper portion of the outer box body, and the disc spring groups are applied with initial pre-pressure by the high-strength bolt according to a design need.

Under action of horizontal shear force, when horizontal relative motion generated by the upper fixed end and the lower fixed end gradually increases (major earthquake), pre-compressed disc spring groups are subjected to secondary compression by a pressure transmission plate and a sliding plate, and at the same time, an anchoring angle provides end portion anchoring for the disc spring groups; and when the action of the horizontal shear force is finished, the disc spring groups subjected to the secondary compression generates resetting force to push the upper fixed end and the lower fixed end to restore to initial positions thereof, thus realizing a self-centering function of the self-adaptive viscous damping wall.

Because of the randomness of earthquake action, an excitation component in a relatively wide frequency domain is included. A conventional viscous damping wall can only dissipate a large amount of energy under high-frequency dynamic excitation and then reduce seismic peak response; the introduced variable viscous damping characteristics can significantly improve the viscous damping force of the conventional viscous damping wall when a displacement response amplitude is relatively large, and a seismic reduction effect under low-frequency dynamic excitation is also taken into account; and the incorporated self-centering technology can reduce the residual displacement of the structure in a relatively wide load frequency domain, and improve the automatic and rapid recovery capability of the structure after earthquakes. It can be seen that the self-adaptive viscous damping wall is more advanced in structural design, and combines the advantages of self-centering technology and viscous damping wall seismic reduction technology, and its stiffness and damping can be adaptively changed according to a preset control target.

The beneficial effects of the present invention are as follows.

1. The conventional viscous damping wall can only consume a large amount of energy under high-frequency dynamic excitation and then reduce earthquake peak response, but the present invention not only guarantees the excellent energy consumption capability under high-frequency dynamic excitation, but also introduces variable viscous damping characteristics which can significantly improve the viscous damping force of the conventional viscous damping wall when a displacement response amplitude is relatively large, so that a seismic reduction effect under low-frequency dynamic excitation is also taken into account, thus taking into account different seismic reduction requirements of both frequent earthquakes and rare earthquakes.
2. The incorporated self-centering technology can reduce the residual displacement of the structure in a relatively wide load frequency domain, and improve the automatic and rapid recovery capability of the structure after earthquakes.
3. The combination of self-centering technology and viscous damping seismic reduction technology has an energy dissipation capability strongly correlated with displacement and velocity, and can realize multi-objective collaborative seismic reduction control of the load-bearing capacity, energy dissipation capability, self-centering capability, and comfort by various structural components, non-structural components, equipment, and personnel; and in particular, it is very advantageous for building structures to resist major earthquakes and super-major earthquakes.
4. The device principle is simple, standardized production and application are easy to be achieved, and the seismic resilience of the structure can be significantly improved without additional energy consumption and self-centering devices, which effectively saves the life cycle cost of the building structure.

DESCRIPTION OF THE EMBODIMENTS

Figure 1:
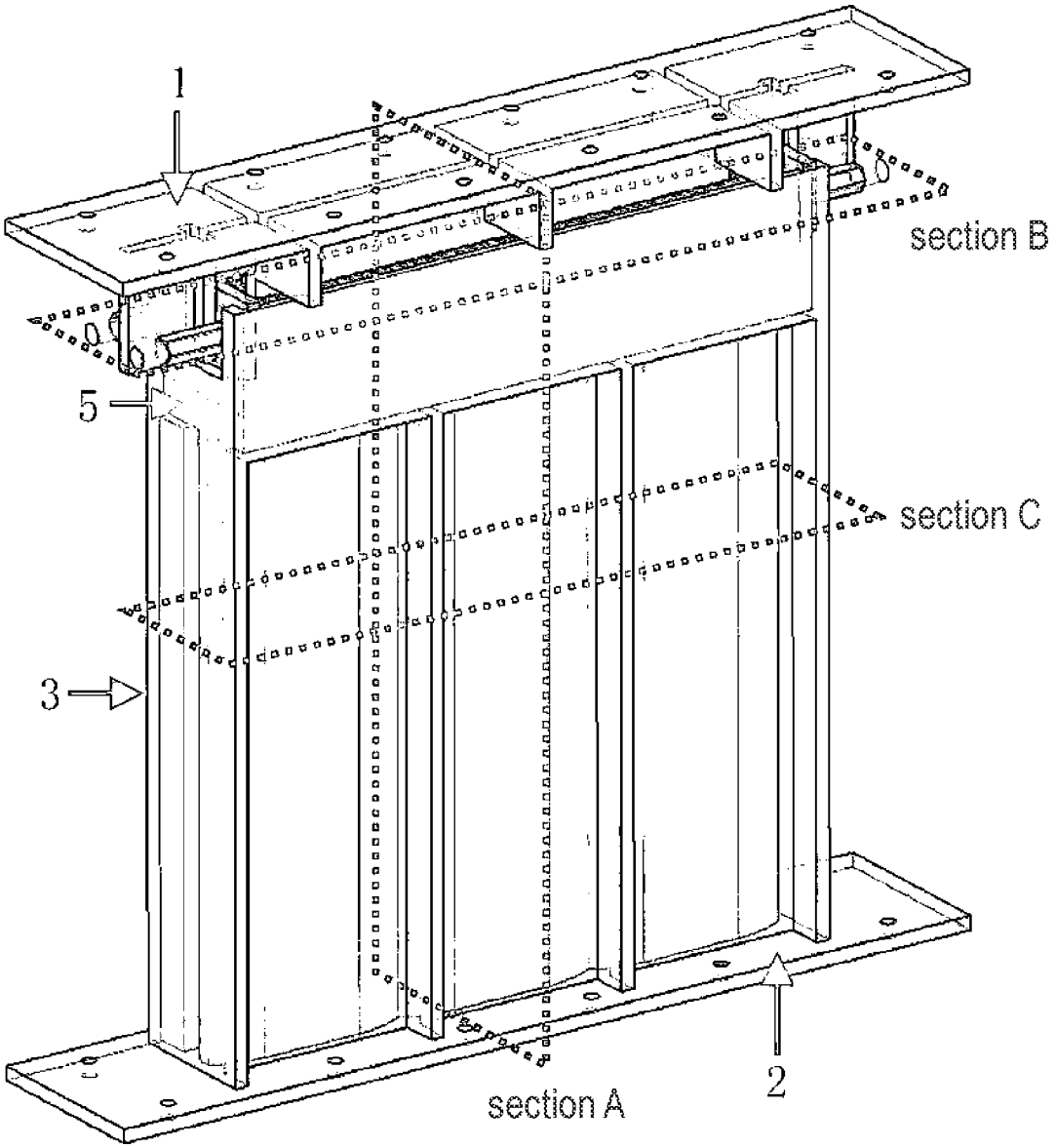
FIG. 1 is a three-dimensional view of a self-adaptive viscous damping wall according to the present invention.

The present invention will be further elucidated below with reference to the accompanying drawings and description of the embodiments. It is to be understood that the following description of the embodiments is only for the illustration of the present invention and is not intended to limit the scope of the present invention.

As shown in FIG. 1 to FIG. 4, the self-adaptive viscous damping wall according to the present invention mainly includes an upper fixed end 1, a lower fixed end 2, an outer box body 3, an inner steel plate 4, a viscous fluid 5, a stiffening key 6, disc spring groups 7, a sliding plate 8, a high-strength bolt 9, a pressure transmission plate 10, a cushion block 11, an opening 12, an anchoring angle 13, and a stiffening plate 14.

Figure 2:
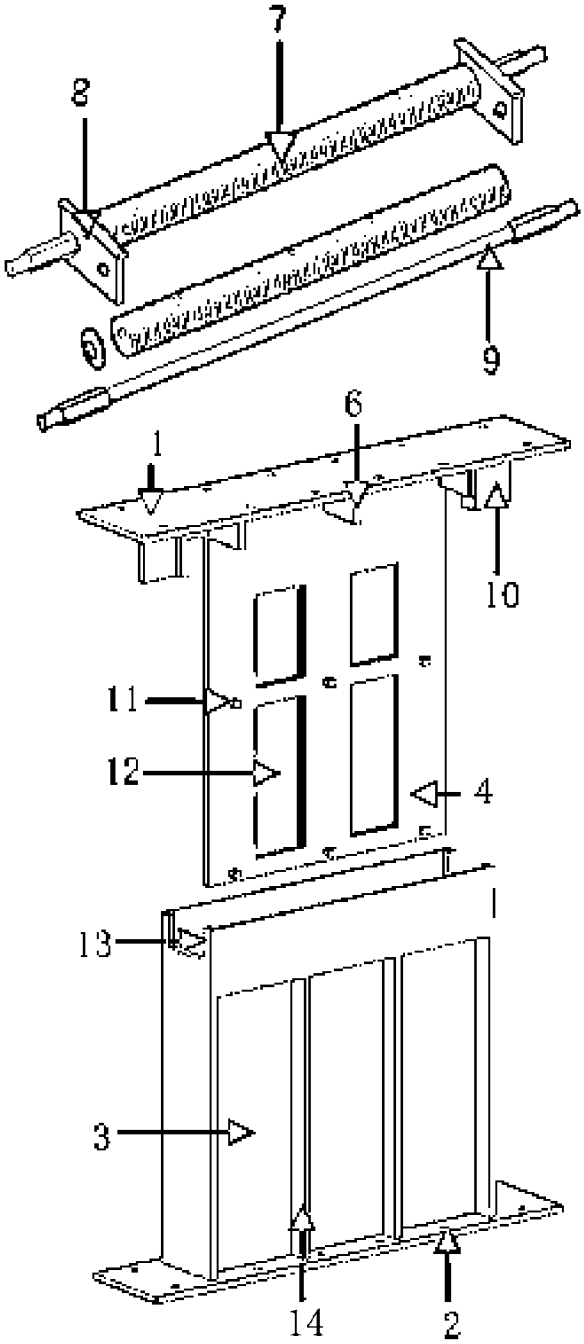
FIG. 2 is a disassembled view of a self-adaptive viscous damping wall according to the present invention.
Figure 3:
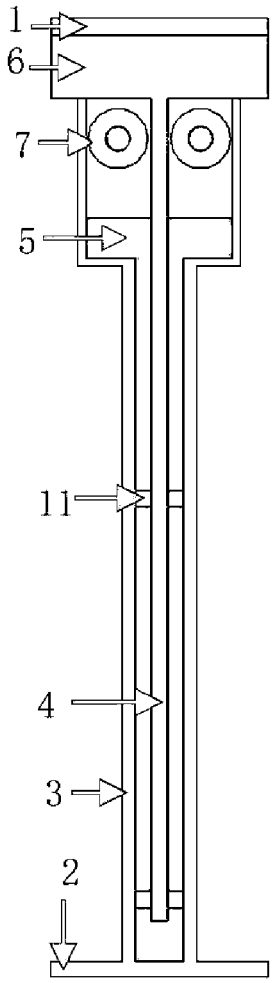
FIG. 3 is a cross-sectional view of section A.
Figure 4:
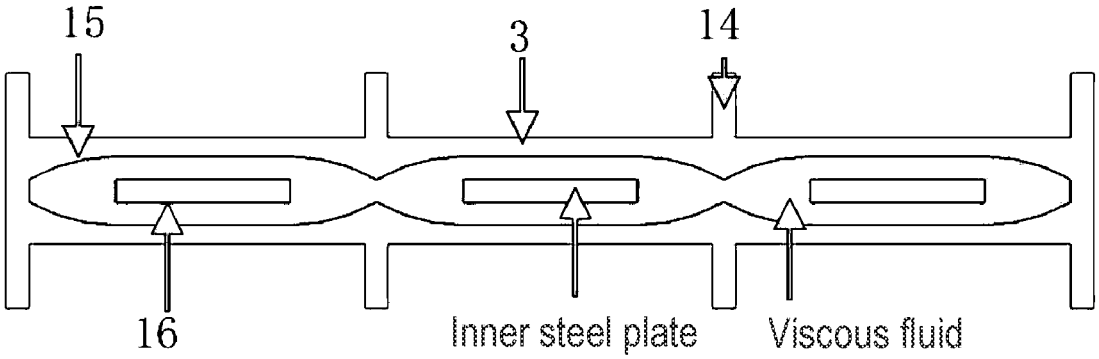
FIG. 4 is a cross-sectional view of section B.
Figure 5:
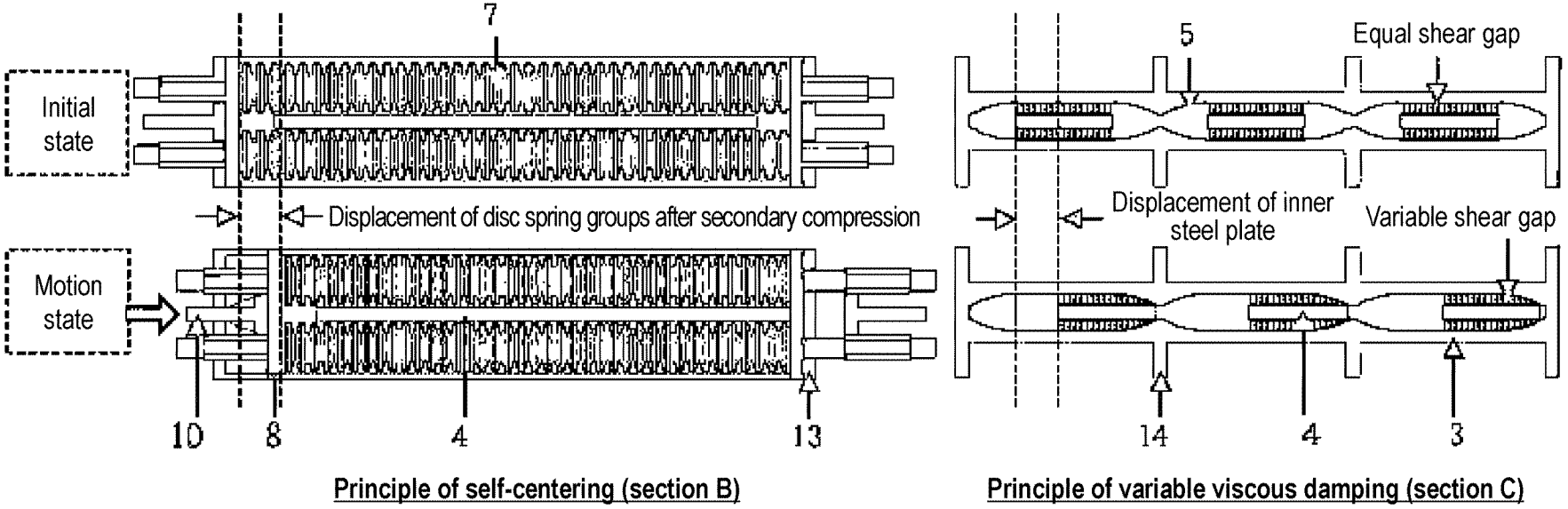
FIG. 5 is a diagram of a working principle of a self-adaptive viscous damping wall according to the present invention.

As shown in FIG. 2, the inner steel plate 4 is a straight steel plate and is provided with a plurality of openings 12, so that the inner steel plate 4 is divided into several vertical wide bands, and two side faces of the vertical wide bands are shear faces of the inner steel plate 16. An upper end of the inner steel plate 4 is fixedly connected with the upper fixed end 1, which is reinforced by the stiffening key 6 to ensure effective transmission of horizontal shear force. In order to prevent the inner steel plate 4 from warping and instability in a working state, several cushion blocks 11 are disposed between an outer side of the inner steel plate and the outer box body 3.

The outer box body 3 is a vertical barrel-shaped component with an upper opening capable of accommodating the inner steel plate 4 and the viscous fluid 5, two sides of an upper portion of the outer box body 3 are provided with notches, and a bottom portion is the lower fixed end 2, which is configured for bottom end anchoring. In order to ensure the safety and reliability of the outer box body 3, several stiffening plates 14 are disposed on an outer side of the outer box body 3 according to a construction requirement.

A part of an inner surface of the outer box body 3 corresponding to a horizontal movement interval of the shear face of the inner steel plate 16 is a shear face of the outer box body 15, the shear face of the outer box body 15 is designed with a multi-section curved face, the curved face adopts a special design of a flat and straight middle portion and a gradually decreasing end portion (an internal cross section is waist-shaped) according to a design need of a seismic objective, and specific parameters are calculated according to required damping force or determined through an experiment.

A distance between the shear face of the outer box body 15 and the shear face of the inner steel plate 16 is a shear gap. When in use, the upper fixed end 1 is anchored with a top end, and the lower fixed end 2 is anchored with a bottom end. During an earthquake, the inner steel plate 4 and the outer box body 3 generate relative motion in a horizontal direction, and then the viscous fluid 5 in the shear gap is driven to undergo shear deformation, thereby generating viscous damping force and then dissipating energy.

The shear face of the outer box body 15 is of a special curved face design, so in an initial state or when an amount of horizontal relative motion generated by the upper fixed end 1 and the lower fixed end 2 is relatively small (minor earthquakes), a shear gap is fixed and unchanged, and viscous damping force only changes with a motion speed and is weakly correlated with displacement; and when the horizontal relative motion gradually increases (major earthquake), the shear gap gradually decreases, and the viscous damping force gradually increases, so the viscous damping force not only changes with the motion speed, but also is strongly correlated with the displacement. In short, the shear gap changes during the motion, so that variable viscous damping force can be generated according to design target displacement, which improves damping efficiency and adaptability.

The self-centering device is disposed at the upper portion of the self-adaptive viscous damping wall, and the device consists of disc spring groups 7, a sliding plate 8, a high-strength bolt 9, a pressure transmission plate 10, and an anchoring angle 13, where the disc spring groups 7 are threaded on the high-strength bolt 9, the sliding plate 8 is disposed at two ends of the two disc spring groups 7, a gap is left between the two disc spring groups 7 and allows the inner steel plate 4 to be inserted, the pressure transmission plate 10 is disposed on an outer side of the sliding plate 8, the pressure transmission plate 10 is disposed at a lower portion of the upper fixed end 1, and the anchoring angle 13 is disposed at the upper portion of the outer box body 3. The disc spring groups 7 are applied with initial pre-pressure by the high-strength bolt 9 according to a design need.

Under action of horizontal shear force, when horizontal relative motion generated by the upper fixed end 1 and the lower fixed end 2 gradually increases, pre-compressed disc spring groups 7 are subjected to secondary compression by a pressure transmission plate 10 and a sliding plate 8, and at the same time, an anchoring angle 13 provides end anchoring for the disc spring groups 7; and when the action of the horizontal shear force is finished, the disc spring groups 7 subjected to the secondary compression generates resetting force to push the upper fixed end 1 and the lower fixed end 2 to restore to initial positions thereof, thus realizing a self-centering function of the self-adaptive viscous damping wall.

Figure 6:
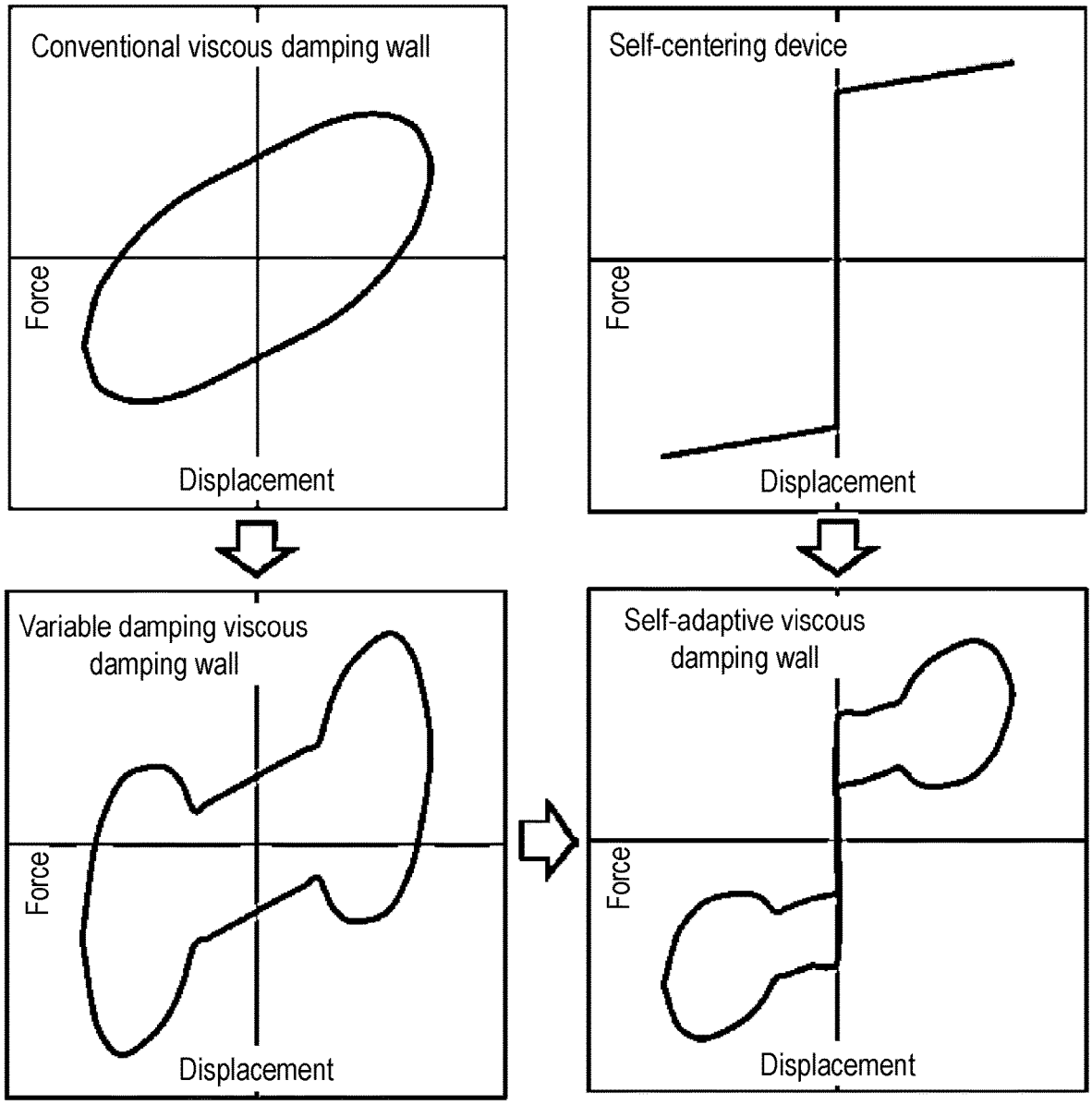
FIG. 6 is an exploded schematic diagram of a hysteretic curve of a self-adaptive viscous damping wall according to the present invention.

Because of the randomness of earthquake action, an excitation component in a relatively wide frequency domain is included. A conventional viscous damping wall can only dissipate a large amount of energy under high-frequency dynamic excitation and then reduce seismic peak response; the introduced variable viscous damping characteristics can significantly improve the viscous damping force of the conventional viscous damping wall when a displacement response amplitude is relatively large, and a seismic reduction effect under low-frequency dynamic excitation is also taken into account; and the incorporated self-centering technology can reduce the residual displacement of the structure in a relatively wide load frequency domain, and improve the automatic and rapid recovery capability of the structure after earthquakes. The exploded schematic diagram of the hysteretic curve of the self-adaptive viscous damping wall is shown in FIG. 6. It can be seen that the self-adaptive viscous damping wall is more advanced in structural design, and combines the advantages of self-centering technology and viscous damping wall seismic reduction technology, and its stiffness and damping can be adaptively changed according to a preset control target.

It should be noted that the above content merely explains the technical idea of the present invention, and cannot limit the scope of protection of the present invention thereby. For those skilled in the art, several improvements and modifications can be made without departing from the principles of the present invention, and these improvements and modifications all fall within the scope of protection of the claims of the present invention.

What is claimed is:

1. A self-adaptive viscous damping wall, comprising: an upper fixed end, a lower fixed end, an outer box body, an inner steel plate, a viscous fluid, and a self-centering device, wherein the inner steel plate is a straight steel plate provided with a plurality of openings, so that the inner steel plate is divided into several vertical bands, and two side faces of the vertical bands are shear faces of the inner steel plate; and an upper end of the inner steel plate is fixedly connected with the upper fixed end;

the outer box body is a vertical barrel-shaped component with an upper opening capable of accommodating the inner steel plate and the viscous fluid, two sides of an upper portion of the outer box body are provided with notches, and a bottom portion of the outer box body is the lower fixed end for bottom end anchoring;

a part of an inner surface of the outer box body corresponding to a horizontal movement interval of the shear faces of the inner steel plate is a shear face of the outer box body, and the shear face of the outer box body is designed with a multi-section curved face, with a flat and straight middle portion and a decreasing end portion; and the self-centering device is disposed at the upper portion of the outer box body, wherein the self-centering device is disposed at the upper portion of the outer box body, and the self-centering device includes disc spring groups, a sliding plate, a bolt, a pressure transmission plate, and an anchoring angle, wherein the disc spring groups are threaded on the bolt, the sliding plate is disposed at two ends of the disc spring groups, a gap is left between the disc spring groups and allows the inner steel plate to be inserted, the pressure transmission plate is disposed on an outer side of the sliding plate, the pressure transmission plate is disposed at a lower portion of the upper fixed end, the anchoring angle is disposed at the notches of the upper portion of the outer box body, and the disc spring groups are applied with initial pre-pressure by the bolt according to a design need.

2. The self-adaptive viscous damping wall according to claim 1, wherein a connection between the inner steel plate and the upper fixed end is provided with a stiffening key.

3. The self-adaptive viscous damping wall according to claim 1, wherein several cushion blocks are disposed between an outer side of the inner steel plate and the outer box body.

4. The self-adaptive viscous damping wall according to claim 1, wherein several stiffening plates are disposed on an outer side of the outer box body.

5. The self-adaptive viscous damping wall according to claim 1, wherein a distance between the shear face of the outer box body and the shear faces of the inner steel plate is a shear gap, and when the upper fixed end and the lower fixed end generate horizontal relative motion, the inner steel plate and the outer box body are driven to generate relative displacement, and the viscous fluid in the shear gap is driven to undergo shear deformation, thereby generating viscous damping force and dissipating energy.

6. The self-adaptive viscous damping wall according to claim 1, wherein a working principle of the self-adaptive viscous damping wall is: in an initial state, a shear gap is fixed and unchanged, and viscous damping force only changes with a motion speed and is correlated with displacement; and when the horizontal relative motion increases, the shear gap decreases, and the viscous damping force increases, so the viscous damping force not only changes with the motion speed, but also is correlated with the displacement.

7. The self-adaptive viscous damping wall according to claim 1, wherein a working principle of the self-adaptive viscous damping wall is: under action of horizontal shear force, when horizontal relative motion generated by the upper fixed end and the lower fixed end increases, pre-compressed disc spring groups are subjected to a secondary compression by a pressure transmission plate and a sliding plate, and at the same time, an anchoring angle provides end portion anchoring for the pre-compressed disc spring groups; and when the action of the horizontal shear force is finished, the pre-compressed disc spring groups subjected to the secondary compression generates resetting force to push the upper fixed end and the lower fixed end to restore to initial positions thereof.

* * * * *